US007565889B2

(12) United States Patent
Iwata et al.

(10) Patent No.: US 7,565,889 B2
(45) Date of Patent: Jul. 28, 2009

(54) VALVE TIMING CONTROL APPARATUS

(75) Inventors: Taiyu Iwata, Anjo (JP); Kenji Fujiwaki, Kariya (JP); Shigeru Nakajima, Anjo (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 83 days.

(21) Appl. No.: 11/885,761

(22) PCT Filed: Feb. 10, 2006

(86) PCT No.: PCT/JP2006/302324

§ 371 (c)(1),
(2), (4) Date: Sep. 6, 2007

(87) PCT Pub. No.: WO2006/095531

PCT Pub. Date: Sep. 14, 2006

(65) Prior Publication Data

US 2008/0163838 A1 Jul. 10, 2008

(30) Foreign Application Priority Data

Mar. 9, 2005 (JP) ..... 2005-065511

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18, 90.27, 90.31; 464/1, 464/2, 160
See application file for complete search history.

(56) References Cited

U.S. PATENT DOCUMENTS 5,836,277 A * 11/1998 Kira et al. ..... 123/90.17
7,007,918 B2 * 3/2006 Kawai et al. ..... 251/89
2001/0054406 A1 12/2001 Okada et al.
2002/0134444 A1 9/2002 Isobe

FOREIGN PATENT DOCUMENTS

JP 9-317410 A 12/1997
JP 9-317411 A 12/1997
JP 2002-4819 A 1/2002
JP 2002-286151 A 10/2002
JP 2003-13713 A 1/2003

OTHER PUBLICATIONS

PCT/ISA/210 and PCT/ISA/237 for PCT/JP2006/302324 dated May 16, 2006.
Official Action issued in CN 2006800077774, Sep. 12, 2008, State Intellectual Property Office of P.R.C.; and English-language translation thereof.
Japanese Office Action in Application No. 2005-065511 with English translation of relevant portion issued Jun. 26, 2008.

* cited by examiner

*Primary Examiner*—Ching Chang
(74) *Attorney, Agent, or Firm*—Buchanan Ingersoll & Rooney PC

(57) ABSTRACT

A valve timing control apparatus includes a locking mechanism that can minimize the accumulation of foreign material in a concave engagement part, can minimize the penetration of foreign material to the sliding parts of a locking member, and can reduce the sliding resistance of the locking member. A locking mechanism is provided with a sliding groove provided to an outer rotor; a locking member for sliding along the sliding groove; and a concave engagement part that is provided to the inner rotor, for engaging with the locking member in a state in which the phase of relative rotation is a lock phase, and has an inlet port for introducing hydraulic fluid. Flow channels for hydraulic fluid are provided to at least one of the sliding groove and the locking member, are formed along the sliding direction of the locking member, and are communicatingly connected to the concave engagement part.

4 Claims, 9 Drawing Sheets

VALVE TIMING CONTROL APPARATUS

TECHNICAL FIELD

The present invention relates to a valve timing control apparatus comprising a drive-side rotating member that rotates in time with a crankshaft of an internal combustion engine; a driven-side rotating member that is positioned coaxially with the drive-side rotating member and that rotates in time with a camshaft; a phase-controlling mechanism for variably controlling the phase of relative rotation between the drive-side rotating member and the driven-side rotating member; and a locking mechanism that is capable of restraining displacement of the phase of relative rotation in a prescribed lock phase.

BACKGROUND ART

There are well-known valve timing control apparatuses for displacing the phase of relative rotation between a drive-side rotating member that rotates in time with a crankshaft and a driven-side rotating member that rotates in time with a camshaft in an automobile engine or other internal combustion engine, whereby valve timing can be appropriately adjusted and an appropriate operational state can be achieved. As an example of this type of valve timing control apparatus for an internal combustion engine, a configuration such as the following is disclosed in Patent Document 1.

As shown in FIG. 14, this valve timing control apparatus comprises an inner rotor 101 fixed to the distal end of a camshaft of an internal combustion engine; an externally mounted outer rotor 102 capable of rotating relative to the inner rotor 101 within a prescribed range; a phase-controlling mechanism that variably controls the phase of relative rotation between the inner rotor 101 and the outer rotor 102 and that includes a fluid-pressure chamber, which is formed between the inner rotor 101 and the outer rotor 102 and is divided into an advance chamber and a retard chamber by vanes assembled on the inner rotor 101; and a locking mechanism 103 for restricting displacement of the phase of relative rotation of the inner rotor 101 and the outer rotor 102.

The locking mechanism 103 is configured having a locking member 105 accommodated in a sliding groove 104 provided to the outer rotor 102; an urging spring 106 for urging the locking member 105 inward in the radial direction; and a concave engagement part 107, which is formed on the inner rotor 101, and into which the radially inward end (the distal end) of the locking member 105 is inserted when the phase of relative rotation between the inner rotor 101 and the outer rotor 102 is the maximum retard phase. The locking member 105 has a corner part 105*a* having an angular shape on the radially inward side and a corner part 105*b* having an arc shape on the radially outward side.

If hydraulic oil is supplied into the concave engagement part 107 of the locking mechanism 103 in a state in which the radially inward end of the locking member 105 is inserted into the concave engagement part 107, the locking member 105 moves outward in the radial direction and unlocks. Since the corner part 105*b* on the radially outward side of the locking member 105 is arc-shaped, sliding resistance due to tilting of the locking member 105 at this time can be alleviated, and friction on the sliding regions is reduced.

[Patent Document 1] Japanese Laid-open Patent Application No. 2003-013713 (p. 2-4, FIG. 2, FIG. 5)

DISCLOSURE OF THE INVENTION

Problems that the Invention is Intended to Solve

In valve timing control apparatuses configured as above, the corner part 105*b* on the radially outward side of the locking member 105 is arc-shaped, and the corner part 105*b* on the radially outward side can therefore be prevented from being trapped and stopped in the sliding groove 104 during unlocking even when the locking member 105 tilts to a certain extent. The reliability of unlocking can therefore be increased. However, the effect of a large reduction in sliding resistance between the locking member 105 and the sliding groove 104 will be unrealized. Conversely, slanting of the locking member 105 is facilitated by the action of the hydraulic oil, and sliding resistance may increase. Due to the high frequency of fluctuation of the torque that acts on the camshaft at high engine speeds, the locking member 105 must operate at high speed in order to unlock the locking mechanism 103. However, the sliding resistance of the locking member 105 must be further reduced as a result.

In valve timing control apparatuses configured as above, the strength of the seal within the concave engagement part 107 when the locking member 105 is inserted must be increased in order to improve the operational efficiency and accelerate the operational speed of the locking member 105. However, foreign material contained in the hydraulic oil readily accumulates within the concave engagement part 107 when the strength of the seal within the concave engagement part 107 is enhanced, and problems have arisen in that the possibility of foreign material penetrating to the sliding parts of the locking member 105 increases.

The urging force of the urging spring 106 must be kept small so that unlocking can be reliably performed even when the sliding resistance of the locking member 105 is large. Problems have therefore arisen in that the operational speed cannot be increased in the direction of insertion of the locking member 105 within the concave engagement part 107. Problems have also arisen in that unlocking may occur due to the centrifugal force resulting from the rotation of the valve timing control apparatus before hydraulic oil is supplied to the concave engagement part 107.

The present invention was devised in light of the aforementioned problems, and it is an object thereof to provide a valve timing control apparatus comprising a locking mechanism that can minimize the accumulation of foreign material in a concave engagement part, can minimize the penetration of foreign material to the sliding parts of a locking member, and can reduce the sliding resistance of the locking member.

Means for Solving the Problems

The valve timing control apparatus according to the present invention for achieving the above objects comprises a drive-side rotating member that rotates in time with a crankshaft of an internal combustion engine; a driven-side rotating member that is positioned coaxially with the drive-side rotating member and that rotates in time with a camshaft; a phase-controlling mechanism for variably controlling a phase of relative rotation between the drive-side rotating member and the driven-side rotating member; and a locking mechanism that is capable of restraining displacement of the phase of relative rotation in a prescribed lock phase, wherein the locking mechanism has a sliding groove provided to one of the drive-side rotating member and the driven-side rotating member, a locking member capable of sliding along the sliding groove, and a concave engagement part that is provided to the other of the drive-side rotating member and the driven-side rotating member, that is formed to be capable of engaging with the locking member in a state in which the phase of relative rotation is the lock phase, and that has an inlet port from which a hydraulic fluid can be introduced, the valve timing control apparatus being characterized in further comprising a flow channel for the hydraulic fluid provided to at least one of the sliding groove and the locking member, formed along a sliding direction of the locking member, and communicatingly connected to the concave engagement part.

According to this characteristic configuration, hydraulic fluid can be made to positively flow within the concave engagement part via the flow channel formed along the sliding direction of the locking member. The accumulation of foreign material due to the retention of hydraulic fluid within the concave engagement part can therefore be minimized, and the penetration of foreign material from the concave engagement part to the sliding parts of the locking member can be prevented.

The flow channel for the hydraulic fluid is preferably configured to be communicatingly connected to a discharge port from which the hydraulic fluid is discharged at an end part opposite from the connection to the concave engagement part.

The hydraulic fluid flowing from the concave engagement part to the flow channel can thereby be properly discharged.

The flow channel for the hydraulic fluid is preferably provided to a sliding surface between the sliding groove and the locking member.

The hydraulic fluid thereby flows along the sliding surfaces of the locking member and the sliding groove, and therefore the sliding surfaces are lubricated by the hydraulic fluid, and the sliding resistance of the locking member can be reduced. The operational speed of the locking member is therefore increased, and the reliability of unlocking can be enhanced. The urging force of the urging member that urges the locking member toward the concave engagement part can be increased by an amount equivalent to the reduction in sliding resistance of the locking member. The speed and reliability of the locking operation can therefore be increased.

The flow channel for the hydraulic fluid is preferably formed by chamfering a corner part of at least one of the sliding groove and the locking member having a polygonal cross section.

If this configuration is used, operational defects resulting from the biting-in of the burrs that remain on the corner parts of one or both of the sliding groove and the locking member can be prevented, and the flow channel for the hydraulic fluid can be formed on the sliding surfaces of the sliding groove and the locking member using a simple configuration.

The flow channel for the hydraulic fluid is preferably formed by a through-hole extending from a radially inward end surface of the locking member to a radially outward end surface.

The hydraulic fluid can thereby be made to positively flow through the flow channel for the hydraulic fluid within the concave engagement part. The accumulation of foreign material due to the retention of hydraulic fluid within the concave engagement part can therefore be minimized, and the penetration of foreign material from the concave engagement part to the sliding parts of the locking member can be prevented.

BEST MODE FOR CARRYING OUT THE INVENTION

First Embodiment

A first embodiment of the present invention will be described below on the basis of the drawings. A valve timing control apparatus 1 of an automobile engine in which the present invention is applied will be described. FIG. 1 is a lateral sectional view that shows the entire configuration of the valve timing control apparatus 1 according to the present embodiment. FIG. 2 is a sectional view of the line II-II in FIG. 1.

(Basic Configuration)

The valve timing control apparatus 1 according to the present embodiment comprises an outer rotor 2 acting as the drive-side rotating member that rotates in time with a crankshaft (not shown) of an engine, and an inner rotor 3 acting as the driven-side rotating member that is positioned coaxially with the outer rotor 2 and that rotates in time with a camshaft 11.

The inner rotor 3 is integrally assembled on the distal end part of the camshaft 11, which constitutes the rotating shaft of a cam for controlling the opening and closing of an intake valve or an exhaust valve of the engine. The camshaft 11 is rotatably assembled on a cylinder head of the engine.

The outer rotor 2 is externally mounted to be capable of rotation relative to the inner rotor 3 within the range of a prescribed phase of relative rotation. A rear plate 21 is integrally attached to the side connected to the camshaft 11, and a front plate 22 is integrally attached to the side opposite from the side connected to the cam shaft 11. A timing sprocket 23 is formed on the outer circumference of the outer rotor 2. A motive-force transmitting member 12 such as timing chain, timing belt etc. is installed between the timing sprocket 23 and a gear attached to the crankshaft of the engine.

When the crankshaft of the engine drives rotation, the rotational force is transmitted to the timing sprocket 23 via the motive-force transmitting member 12. The outer rotor 2 thereby drives rotation in the rotational direction S shown in FIG. 2. The inner rotor 3 then drives rotation in the rotational direction S, and the cam shaft 11 rotates. A cam provided to the cam shaft 11 then presses down and opens the intake or exhaust valve of the engine.

A plurality of protruding parts 24 that function as shoes protruding inward in the radial direction are arranged apart from one another on the outer rotor 2 along the direction of rotation, as shown in FIG. 2. Fluid-pressure chambers 4 defined by the outer rotor 2 and the inner rotor 3 are formed in the spaces between adjoining protruding parts 24 of the outer rotor 2. Five fluid-pressure chambers 4 are provided in the configuration shown in FIG. 2.

Vane grooves 31 are formed in locations facing each of the fluid-pressure chambers 4 on the outer circumference part of the inner rotor 3. Vanes 32 that partition the fluid-pressure chambers 4 into advance chambers 41 and retard chambers 42 in the direction of relative rotation (the direction of the arrows S1, S2 in FIG. 2) are slidably inserted along the radial direction in the vane grooves 31. The vanes 32 are urged outward in the radial direction by springs 33 provided to the inside-diameter sides of the vanes, as shown in FIG. 1.

The advance chambers 41 of the fluid-pressure chambers 4 are communicatingly connected to advance channels 43 formed in the inner rotor 3, and the retard chambers 42 are communicatingly connected to retard channels 44 formed in the inner rotor 3. As shown in FIG. 2, one of the five advance channels 43 in the present example is an unlocking advance channel 43*a* that is communicatingly connected to an advance chamber 41 via a concave engagement part 51 of a locking mechanism 5. The term "advance channels 43" will hereinafter include this unlocking advance channel 43*a* unless otherwise noted. The advance channels 43 and the retard channels 44 are connected to a hydraulic circuit 7 described hereinafter. Hydraulic oil from the hydraulic circuit 7 is supplied to or discharged from the advance chambers 41 and/or the retard chambers 42. Thereby an urging force that displaces the phase of relative rotation between the inner rotor 3 and the outer rotor 2 (referred to below as simply "the phase of relative rotation") in the advance direction S1 (i.e., the vanes 32 are displaced in the direction of the arrow S1 in FIG. 2), or in the retard direction S2 (i.e., the vanes 32 are displaced in the direction of the arrow S2 in FIG. 2), or, an urging force that maintains any desired phase is produced. The hydraulic oil in the present embodiment is equivalent to the "hydraulic fluid" of the present invention.

A torsion spring 8 is provided between the inner rotor 3 and the front plate 22 fixed to the outer rotor 2, as shown in FIG. 1. Both ends of the torsion spring 8 are held by holding parts formed respectively on the inner rotor 3 and the front plate 22. The torsion spring 8 provides a torque that constantly urges the inner rotor 3 and the outer rotor 2 in a direction in which the phase of relative rotation is displaced in the advance direction S1.

(Configuration of the Locking Mechanism)

A locking mechanism 5 is provided between the outer rotor 2 and the inner rotor 3. This locking mechanism is capable of restraining displacement of the phase of relative rotation of the inner rotor 3 and the outer rotor 2 in a prescribed lock phase (the phase shown in FIG. 2). The locking mechanism 5 is configured having a sliding groove 52 provided to the outer rotor 2; a locking member 53 capable of sliding along the sliding groove 52; an urging spring 54 for urging the locking member 53 inward in the radial direction (toward the inner rotor 3, toward the bottom in FIG. 3); and a concave engagement part 51 that is provided to the inner rotor 3 and that is formed to be capable of engaging with the locking member 53 in a state in which the phase of relative rotation is a lock phase.

The configuration of the locking mechanism 5 will be described in detail below. FIG. 3 is a lateral sectional view that shows the configuration of the locking mechanism 5. FIG. 4 is a sectional view of the line IV-IV in FIG. 3. FIG. 5 is a view from the direction of the arrow V in FIG. 3. FIG. 6 is an exploded perspective view of the locking mechanism 5.

As shown in FIGS. 3 through 6, the locking member 53 in the present embodiment is shaped as a flat plate that has a rectangular cross section (the shape shown in FIG. 4) and that is substantially rectangular (the shape shown in FIG. 3) when viewed from the front. A spring-holding part 53*a* that holds one end of the urging spring 54 is formed on the radially outward side (the upper side in FIG. 3) of the locking member 53. The locking member 53 is positioned to be capable of sliding along the sliding groove 52.

The urging spring 54 is positioned within a spring-accommodating chamber 55 formed on the radially outward side relative to the sliding groove 52 on the outer rotor 2. One end of the urging spring 54 is held by the spring-holding part 53*a* of the locking member 53, and the other end is in contact with a wall 55*a* on the radially outward side of the spring-accommodating chamber 55. The urging spring 54 thereby urges the locking member 53 inward in the radial direction.

The spring-accommodating chamber 55 is connected to the sliding groove 52 on the radially inward side and is connected to a discharge channel 56 on the radially outward side. The discharge channel 56 communicatingly connects the outer circumferential surface of the outer rotor 2 to the outside. Specifically, the discharge channel 56 comprises a concave groove formed on a lateral surface that is in contact with the front plate 22 and the rear plate 21 and is on the wall 55*a* on the radially outward side of the spring-accommodating chamber 55 of the outer rotor 2, as shown in FIGS. 3 and 5. The discharge channel 56 of the present embodiment is equivalent to the "discharge port" of the present invention.

The sliding groove 52 has sliding walls 52*a*, which are provided to the outer rotor 2 and are in contact with both surfaces of the locking member 53; and lateral walls 52*b*, which are formed respectively by the front plate 22 and the rear plate 21 on both sides of the locking member 53. The sliding groove 52 thereby forms a sliding space having a substantially rectangular cross section that coincides with the shape of the cross section of the locking member 53. The sliding walls 52*a* and the lateral walls 52*b* constitute the sliding surfaces for the locking member 53.

Hydraulic fluid channels 57, in which hydraulic oil flows, are formed at the connecting parts of the sliding walls 52*a* and the lateral walls 52*b* in the present embodiment. Specifically, the hydraulic fluid channels 57 are configured by chamfering the corner parts on both ends of the sliding walls 52*a*. The hydraulic fluid channels 57 are thereby configured to be formed along the sliding direction of the locking member 53, to be communicatingly connected to the concave engagement part 51 on the radially inward side, and to be communicatingly connected to the discharge channel 56 via the spring-accommodating chamber 55 on the radially outward side. These hydraulic fluid channels 57 are equivalent to the "flow channel for hydraulic fluid" of the present invention.

The concave engagement part 51 is provided to the inner rotor 3 and is formed to be capable of engaging with the radially inward end parts of the locking member 53. The concave engagement part 51 is formed in the shape of a concave groove having a substantially rectangular cross section that coincides with the shape of the cross section of the locking member 53 in the present embodiment. The concave engagement part 51 is provided to a location capable of engagement with the locking member 53 in a state in which the phase of relative rotation between the inner rotor 3 and the outer rotor 2 is a lock phase. The locking member 53 protrudes and engages within the concave engagement part 51, whereby the locking mechanism 5 assumes a locked configuration, and the phase of relative rotation is restrained in a lock phase (the phase shown in FIG. 2). The lock phase is usually established as a phase in which the engine can be started smoothly. The lock phase in this instance is established as the most retard phase of relative rotation.

The concave engagement part 51 has an inlet port 58 capable of introducing hydraulic oil. One of the advance channels 43 in this case is the unlocking advance channel 43*a* that is communicatingly connected to the concave engagement part 51. The connecting part of the unlocking advance channel 43*a* and the concave engagement part 51 is the inlet port 58. The concave engagement part 51 is also communicatingly connected to one of the advance chambers 41 via a communicating channel 45 formed along the outer circumferential surface of the inner rotor 3. In other words, the advance chamber 41 positioned adjacent to the locking mechanism 5 is configured to be communicatingly connected to the unlocking advance channel 43*a* via the concave engagement part 51 and the communicating channel 45 and to receive a supply of hydraulic oil therefrom.

The disengagement of the locking member 53 from the concave engagement part 51 is performed by supplying hydraulic oil from the inlet port 58 into the concave engagement part 51. In other words, the concave engagement part 51 is supplied and filled with hydraulic oil. When the forces that urges the locking member 53 radially outward via the pressure of the hydraulic oil becomes larger than the urging force of the urging spring 54, the locking member 53 disengages from the concave engagement part 51, as shown in FIG. 7. Displacement of the phase of relative rotation between the inner rotor 3 and the outer rotor 2 is thereby rendered permitted.

(Configuration of the Hydraulic Circuit)

The hydraulic circuit 7 is provided with an oil pump 71 that is driven by the driving force of the engine and that pumps hydraulic oil; a control valve 73 that is controlled by a control unit 72 and that controls the supply or discharge of hydraulic oil from a plurality of ports; and an oil pan 74 for storing hydraulic oil. As an example, a variable electromagnetic spool valve is used as the control valve 73, in which a spool slidably positioned within a sleeve 73*b* is displaced against a spring by the passage of electric current from the control unit 72 to a solenoid 73*a*.

The control valve 73 has a high-pressure port 73*c* to which hydraulic oil pumped from the oil pump 71 is supplied; an advance port 73*d* that is communicatingly connected to the advance chambers 41 via the advance channels 43; a retard port 73*e* that is communicatingly connected to the retard chambers 42 via the retard channels 44; and a drain port 73*f* that is communicatingly connected to the oil pan 74. The control valve 73 is controlled by the control unit 72 and controls the opening or blocking of the aforementioned ports, whereby the supply or discharge of hydraulic oil to and from the advance chambers 41 and/or the retard chambers 42 is controlled. The control valve 73 thereby displaces the relative positions of the vanes 32 within the fluid-pressure chambers 4 or maintains them at an arbitrary phase, and the phase of relative rotation between the inner rotor 3 and the outer rotor 2 is controlled. The control valve 73, as well as the fluid-pressure chambers 4 to and from which hydraulic oil is supplied or discharged via the control valve 73, and the vanes 32 that divide the fluid-pressure chambers 4 into the retard chambers 42 and the advance chambers 41, constitute a "phase-controlling mechanism 6" of the present invention.

(Operation of the Locking Mechanism)

When hydraulic oil is supplied to the advance channels 43 via the control valve 73 in a state in which the locking member 53 protrudes into the concave engagement part 51 and the locking mechanism 5 is in the locked configuration, as shown in FIG. 2, hydraulic oil is first supplied to the concave engagement part 51 from the unlocking advance channel 43*a*. Unlocking is performed by supplying hydraulic oil into the concave engagement part 51 from the inlet port 58. Specifically, the concave engagement part 51 is supplied and filled with hydraulic oil, and the locking member 53 disengages from the concave engagement part 51 and realizes unlocked configuration due to the pressure of the hydraulic oil, as shown in FIG. 7. Displacement of the phase of relative rotation between the inner rotor 3 and the outer rotor 2 is thereby permitted. Hydraulic oil is also supplied via the communicating channel 45 to the advance chamber 41 adjoining the locking mechanism 5 at the stage in which the locking member 53 is displaced radially outward from the locked configuration shown in FIG. 2.

On the other hand, when the phase of relative rotation between the inner rotor 3 and the outer rotor 2 came into the lock phase in a state in which hydraulic oil is not supplied to the unlocking advance channel 43*a*, the locking member 53 protrudes and engages within the concave engagement part 51. The locking mechanism 5 thereby realizes a locked configuration.

When hydraulic oil is supplied into the concave engagement part 51 from the inlet port 58 and unlocking is performed, hydraulic oil that has filled the concave engagement part 51 pushes the locking member 53 back outward in the radial direction and flows into the hydraulic fluid channels 57. This state is shown in FIG. 8 and FIG. 9, which is a sectional view of the line IX-IX in FIG. 8. The hydraulic oil that has flowed into the hydraulic fluid channels 57 enters the spring-accommodating chamber 55 and is then discharged to the outside from the discharge channel 56.

Hydraulic oil thereby flows along the sliding surfaces of the locking member 53 and the sliding groove 52. The sliding surfaces are therefore positively lubricated by hydraulic oil, and the sliding resistance of the locking member 53 can be reduced. Hydraulic oil is made to positively flow within the concave engagement part 51 via the hydraulic fluid channels 57, whereby the accumulation of foreign material due to the retention of hydraulic oil within the concave engagement part 51 can be minimized.

Second Embodiment

A second embodiment of the present invention will be described next. FIG. 10 is a sectional view that shows the configuration of the locking mechanism 5 according to the present embodiment and is a sectional view equivalent to the section obtained by the line X-X in FIG. 3. FIG. 11 is an exploded perspective view of the locking mechanism according to the present embodiment. The hydraulic fluid channels 57 in the locking mechanism 5 according to the present embodiment are configured by chamfering the corner parts of the lateral surfaces of the locking member 53, as shown in FIGS. 10 and 11. The hydraulic fluid channels 57 are thereby formed on the sliding surfaces of the sliding groove 52 and the locking member 53 along the direction of sliding of the locking member 53. The hydraulic fluid channels 57 are configured to be communicatingly connected to the concave engagement part 51 on the radially inward side and to be communicatingly connected to the discharge channel 56 via the spring-accommodating chamber 55 on the radially outward side. The rest of the configuration is identical to the first embodiment.

Hydraulic oil thereby flows along the sliding surfaces of the locking member 53 and the sliding groove 52 as is the case in the first embodiment. The sliding surfaces are therefore positively lubricated by hydraulic oil, and the sliding resistance of the locking member 53 can be reduced. Hydraulic oil is made to positively flow within the concave engagement part 51 via the hydraulic fluid channels 57, whereby the accumulation of foreign material due to the retention of hydraulic oil within the concave engagement part 51 can be minimized.

The hydraulic fluid channels 57 are not formed on the sliding groove 52 in the present embodiment, but forming the hydraulic fluid channels 57 on both the locking member 53 and the sliding groove 52 is also a preferable embodiment of the present invention.

Third Embodiment

A third embodiment of the present invention will be described next. FIG. 12 is a sectional view that shows the configuration of the locking mechanism 5 according to the present embodiment and is a sectional view equivalent to the section obtained by the line XII-XII in FIG. 3. FIG. 13 is an exploded perspective view of the locking mechanism according to the present embodiment. The hydraulic fluid channels 57 in the locking mechanism 5 according to the present embodiment are formed inside the locking member 53, as shown in FIGS. 12 and 13, instead of on the sliding surfaces of the sliding groove 52 and locking member 53. Specifically, through-holes extending from the radially inward end surface of the locking member 53 to the radially outward end surface of the same are formed to communicatingly connect these surfaces. These through-holes are the hydraulic fluid channels 57. Two through-holes having circular cross sections are formed in the example shown in FIGS. 12 and 13. The hydraulic fluid channels 57 are thereby formed along the sliding direction of the locking member 53. The hydraulic fluid channels 57 are configured to be communicatingly connected to the concave engagement part 51 on the radially inward side and to be communicatingly connected to the discharge channel 56 via the spring-accommodating chamber 55 on the radially outward side. The rest of the configuration is identical to the first embodiment.

Hydraulic oil can thereby be made to positively flow within the concave engagement part 51 via the hydraulic fluid channels 57, and therefore the accumulation of foreign material due to the retention of hydraulic oil within the concave engagement part 51 can be minimized.

The formation of both the hydraulic fluid channels 57 described in the present embodiment and the hydraulic fluid channels 57 described in the first or second embodiment is also a preferable embodiment of the present invention.

Other Embodiments (1) The locking member 53 was described as being shaped as a flat plate having a rectangular cross section in the embodiments above. However, the locking member 53 is not limited to this shape. In other words, another plate shape, a pin shape having a polygonal or circular cross section, or a variety of other shapes may be employed as the shape of the locking member 53. The shape of the sliding groove 52 is made to match the shape of the locking member 53 in such instances.

(2) The hydraulic fluid channels 57 were described in the first and second embodiments above as being configured by chamfering the corner parts of one or both of the locking member 53 and the sliding groove 52, which have square cross sections. Even when the sliding groove 52 and the locking member 53 are shaped to have polygonal cross sections other than square shapes, the hydraulic fluid channels 57 can be configured by chamfering the polygonal corner parts of one or both of the sliding groove 52 and the locking member 53 in the same manner.

(3) The locking mechanism 5 in the embodiments above was described as entering a locked configuration due to the locking member 53, which was provided to be capable of sliding along the sliding groove 52 provided to the outer rotor 2, protruding into the concave engagement part 51 provided to the inner rotor 3. However, it shall be apparent that the relationship between the inner rotor 3 and the outer rotor 2 may also be reversed. In other words, a configuration is also possible in which the locked configuration occurs due to the locking member 53, which is provided to be capable of sliding along a sliding groove 52 provided to the inner rotor 3, protruding into a concave engagement part 51 provided to the outer rotor 2.

EXPLANATION OF THE REFERENCE NUMBERS

Figure 1:
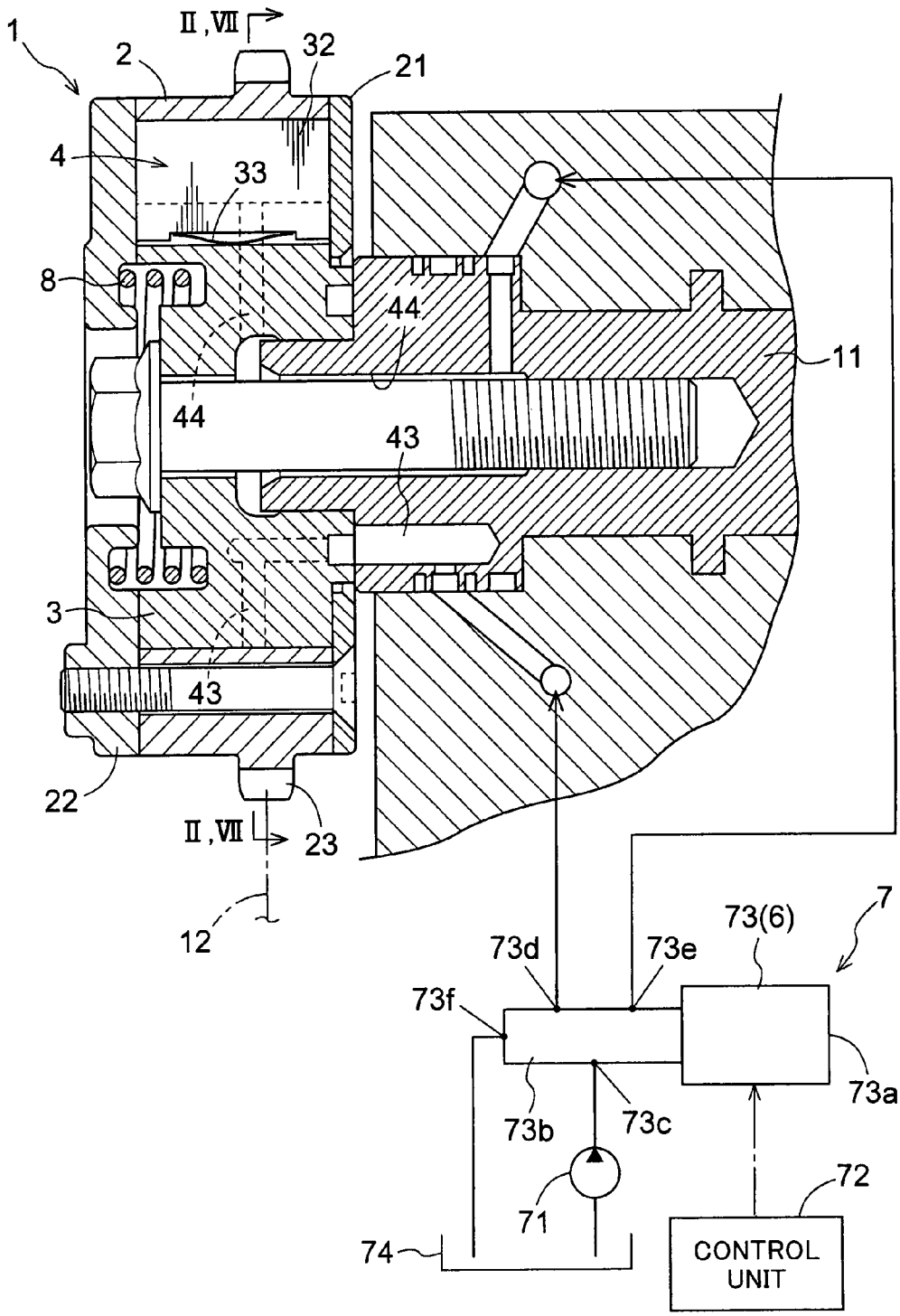
FIG. 1 is a lateral sectional view that shows the entire configuration of a valve timing control apparatus according to a first embodiment of the present invention.
Figure 2:
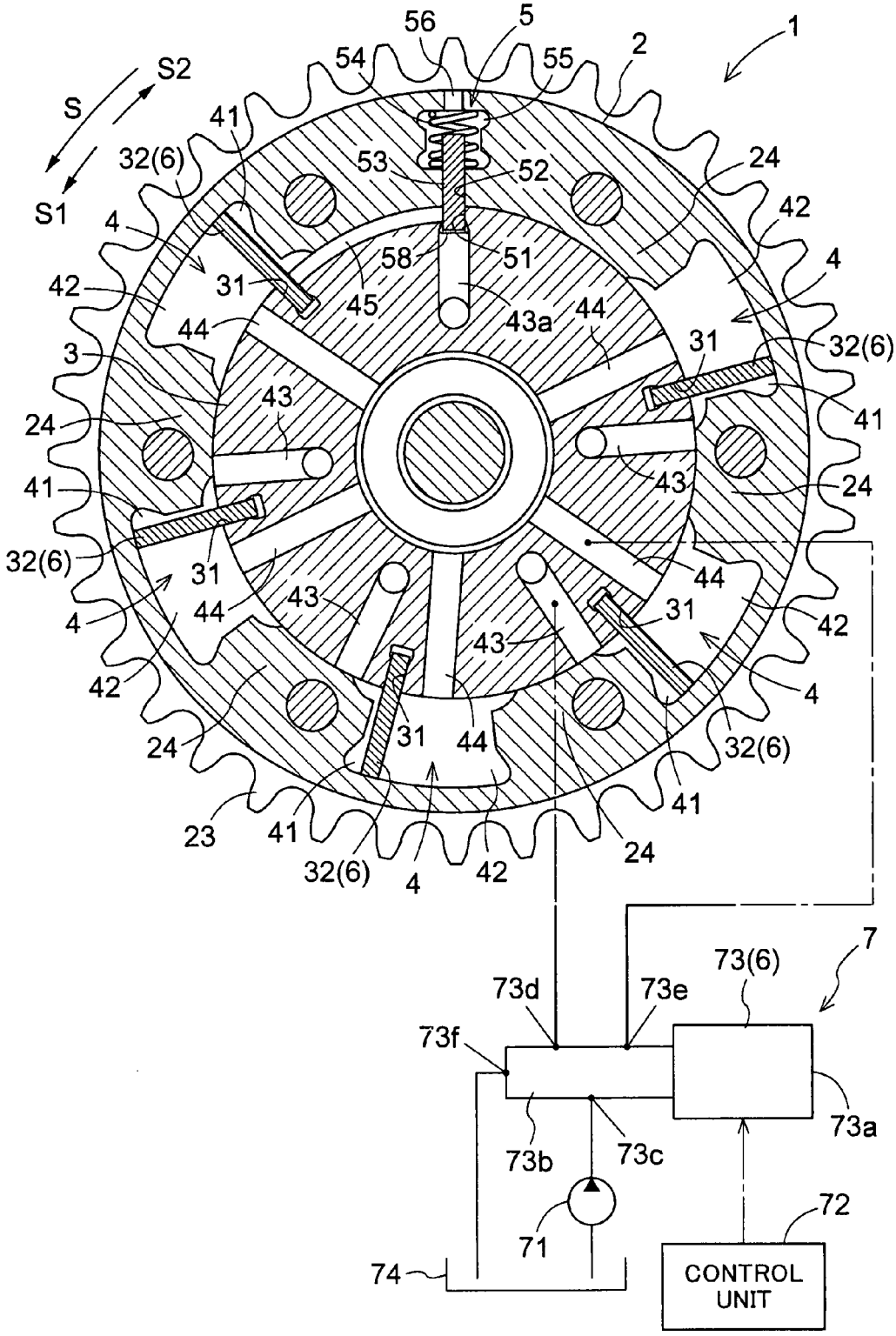
FIG. 2 is a sectional view of the line II-II in FIG. 1 (locked configuration)
Figure 3:
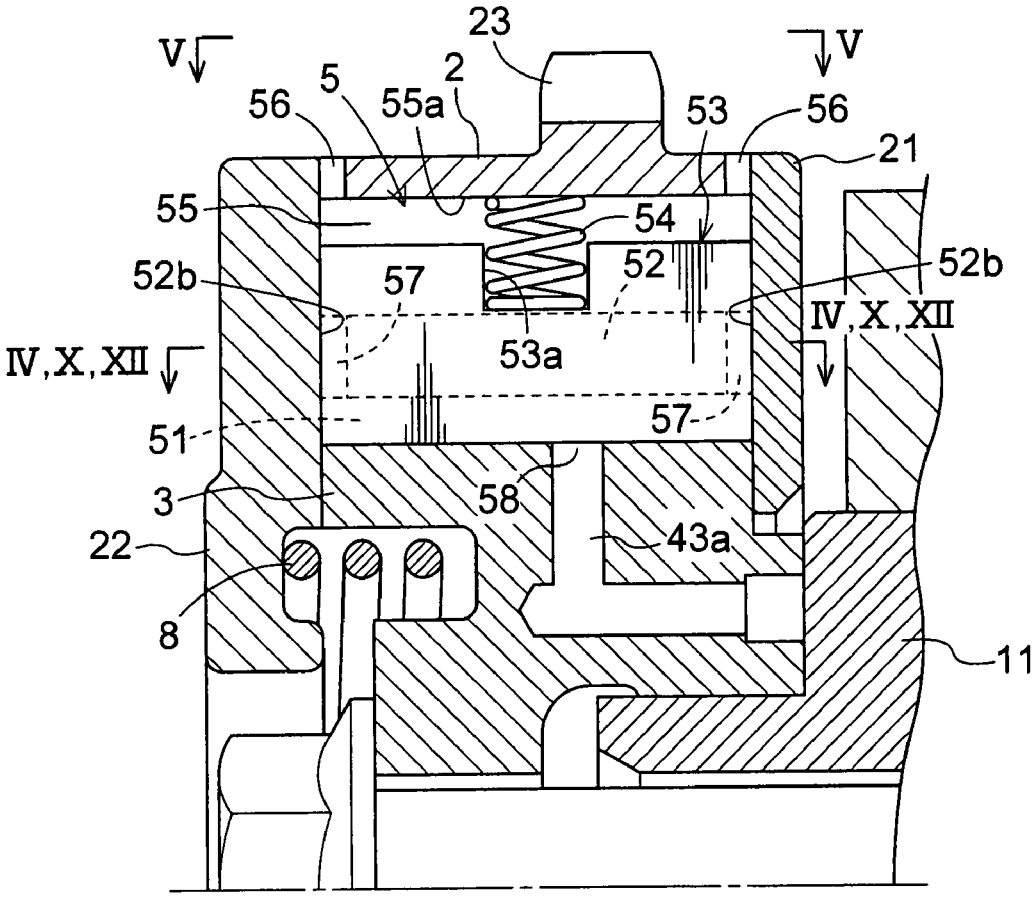
FIG. 3 is a lateral sectional view that shows the configuration of a locking mechanism according to the first embodiment of the present invention.
Figure 4:
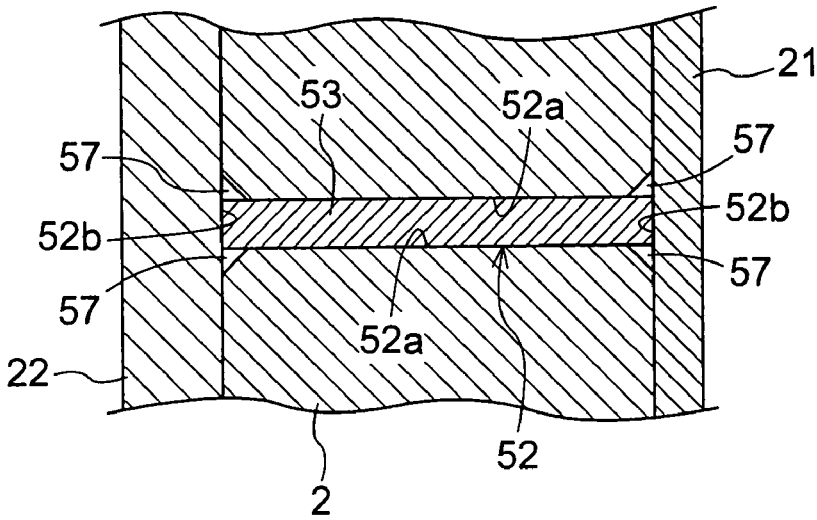
FIG. 4 is a sectional view of the line IV-IV in FIG. 3.
Figure 5:
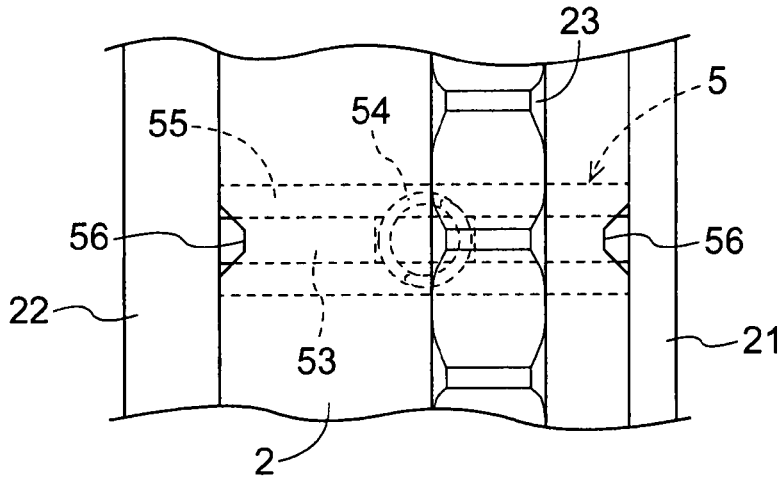
FIG. 5 is a view from the direction of the arrow V in FIG. 3.
Figure 6:
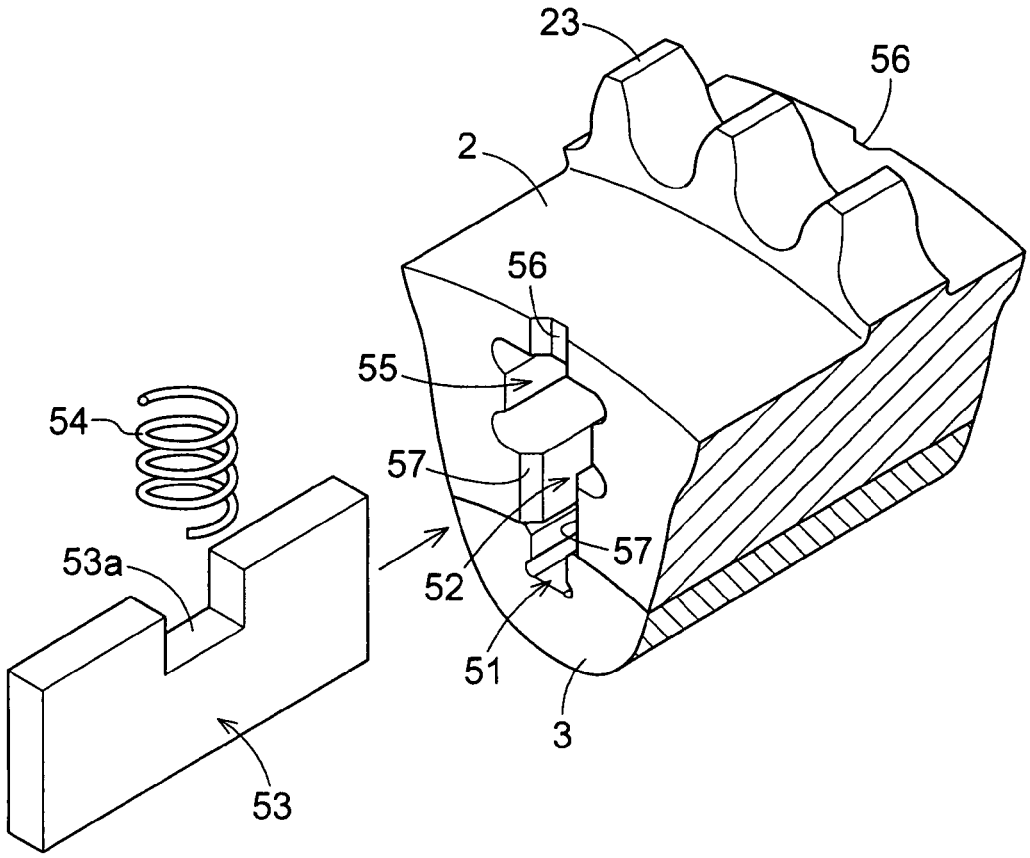
FIG. 6 is an exploded perspective view of the locking mechanism according to the first embodiment of the present invention.
Figure 7:
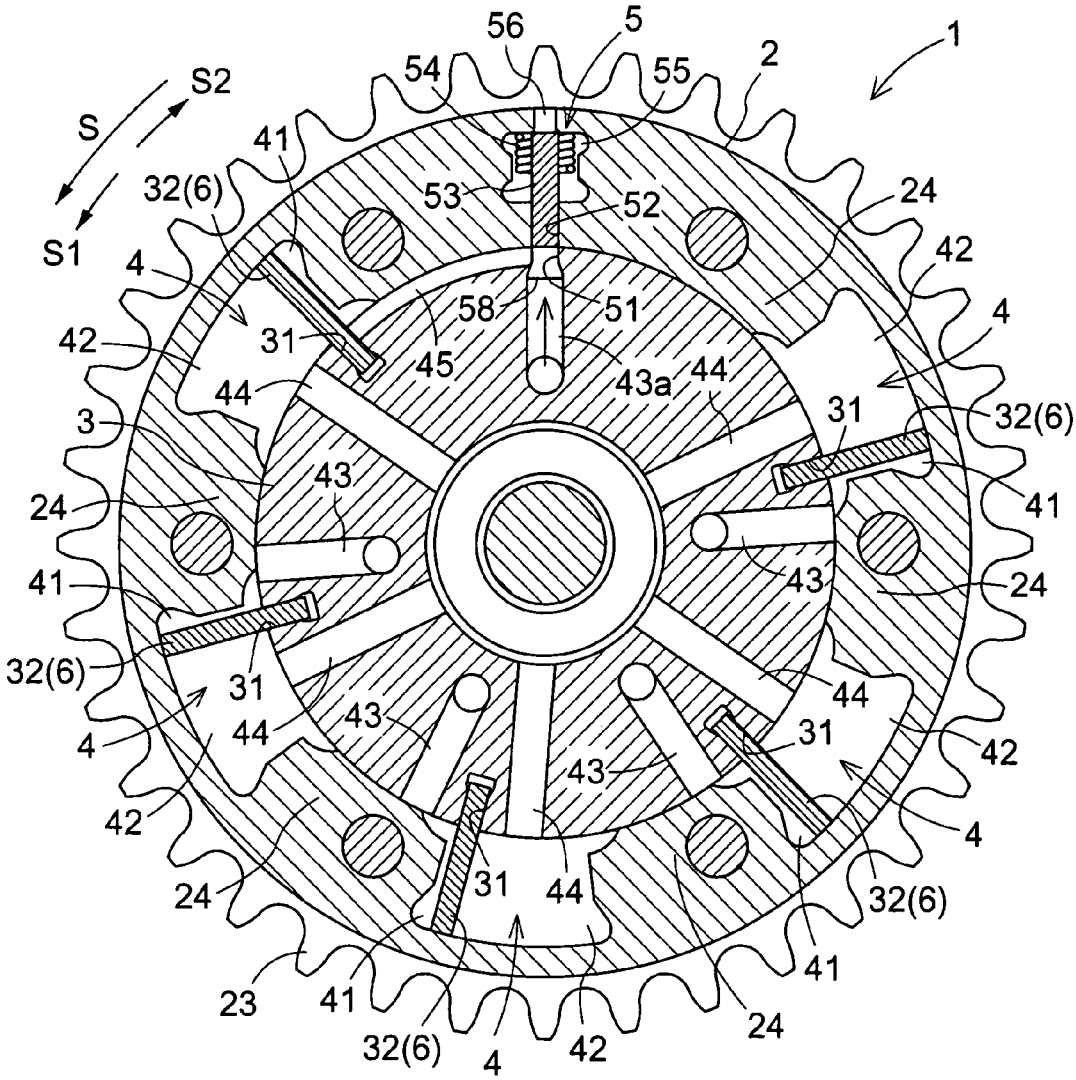
FIG. 7 is a sectional view of the line VII-VII in FIG. 1 (unlocked configuration)
Figure 8:
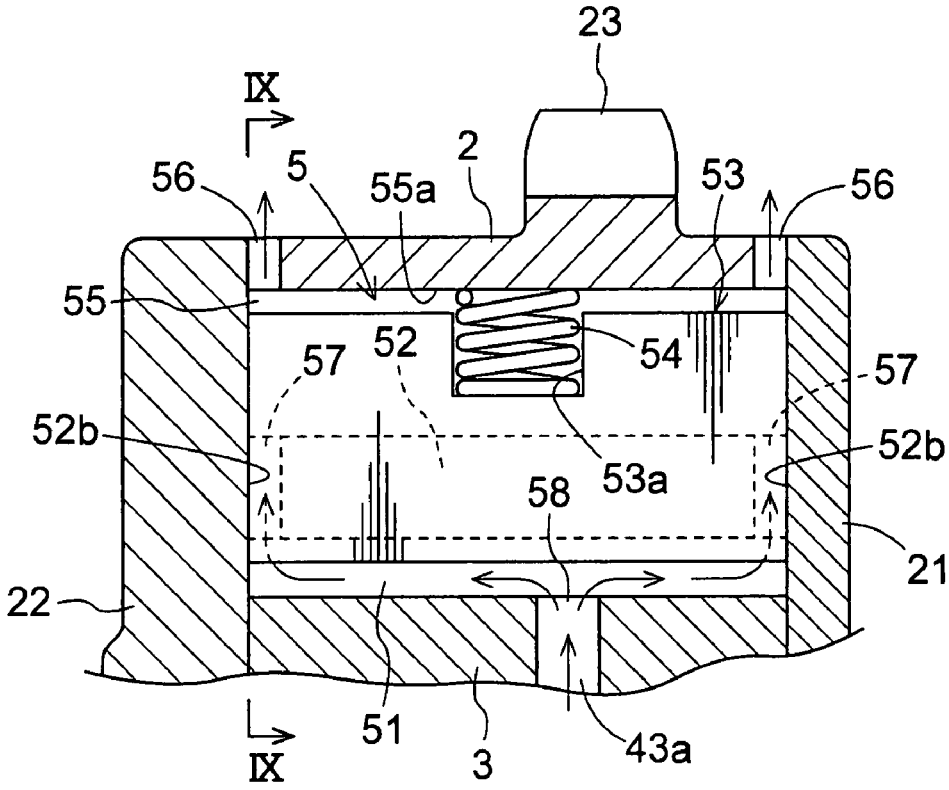
FIG. 8 is a diagram for describing the operation of the locking mechanism according to the first embodiment of the present invention.
Figure 9:
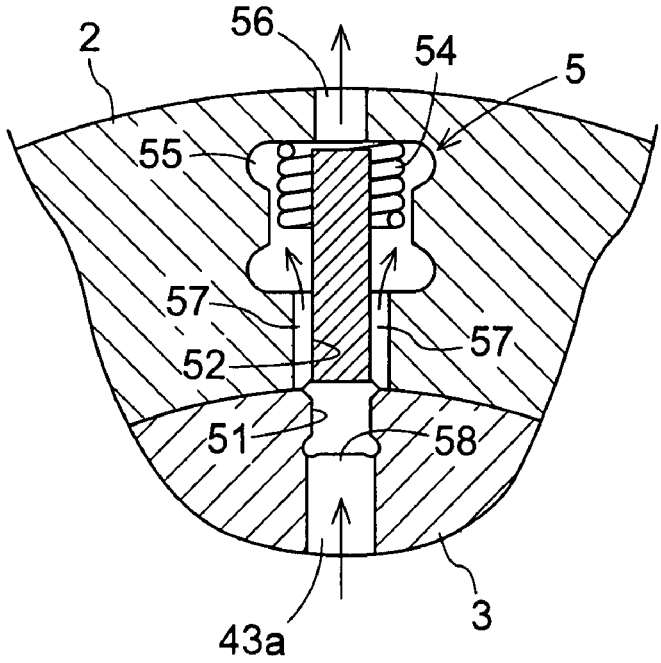
FIG. 9 is a sectional view of the line IX-IX in FIG. 8.
Figure 10:
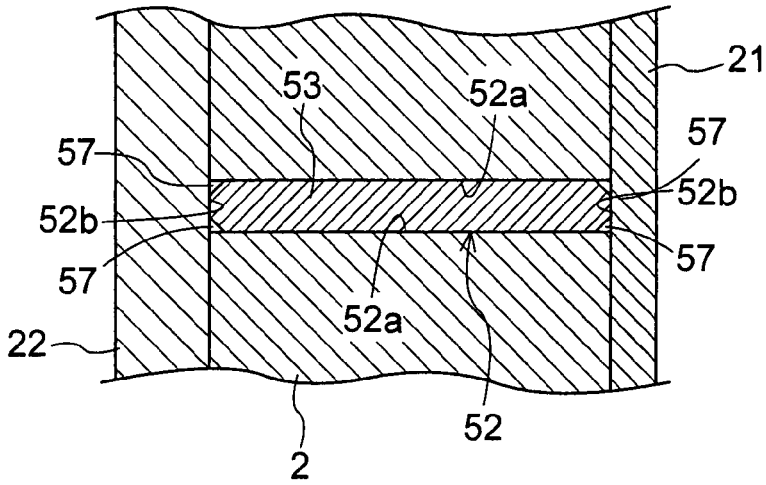
FIG. 10 is a sectional view that shows the configuration of the locking mechanism according to a second embodiment of the present invention.
Figure 11:
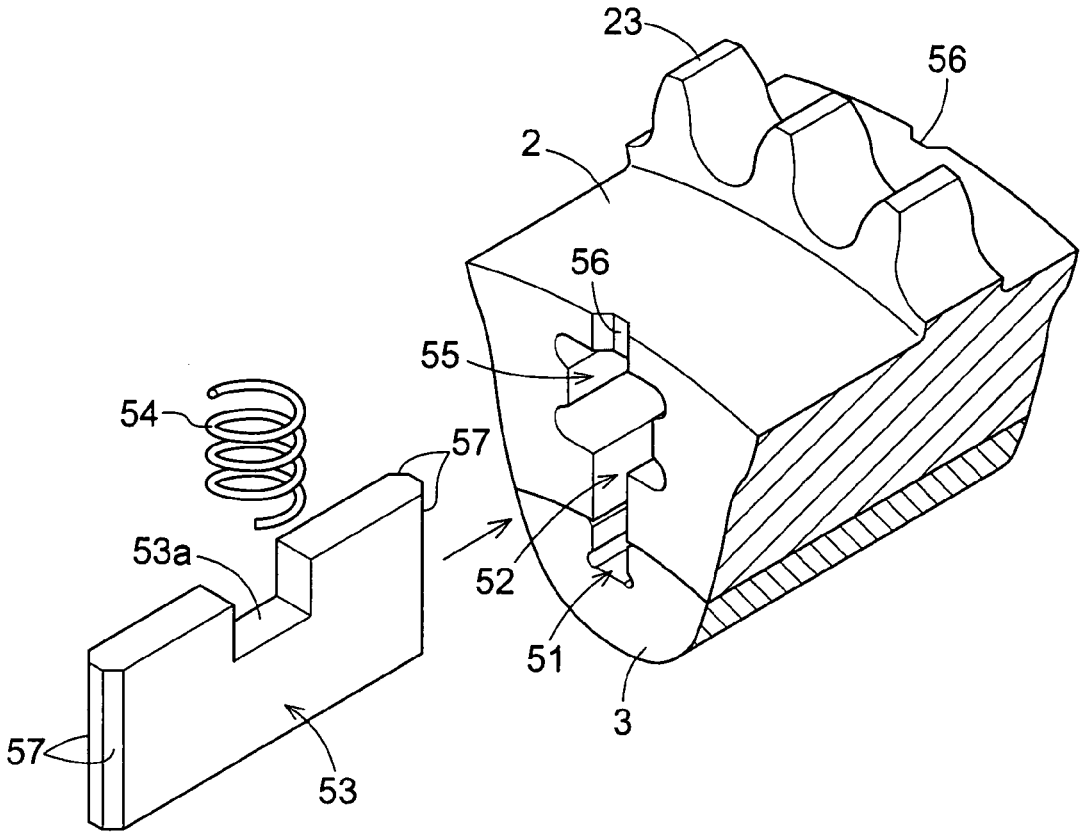
FIG. 11 is an exploded perspective view of the locking mechanism according to the second embodiment of the present invention.
Figure 12:
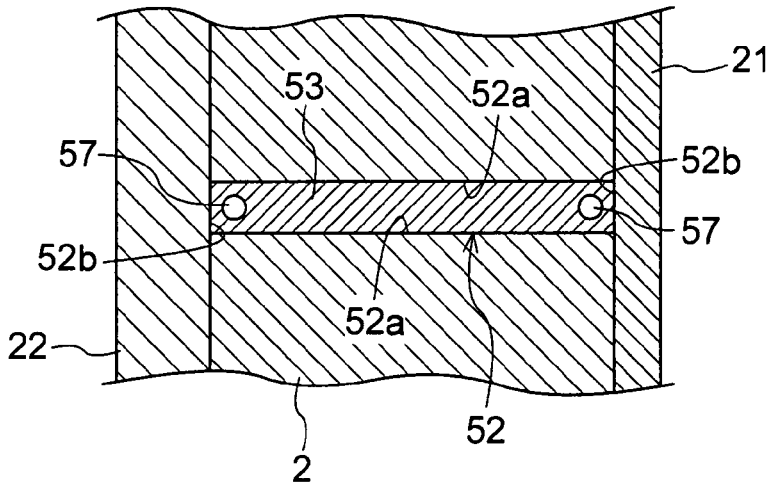
FIG. 12 is a sectional view that shows the configuration of the locking mechanism according to a third embodiment of the present invention.
Figure 13:
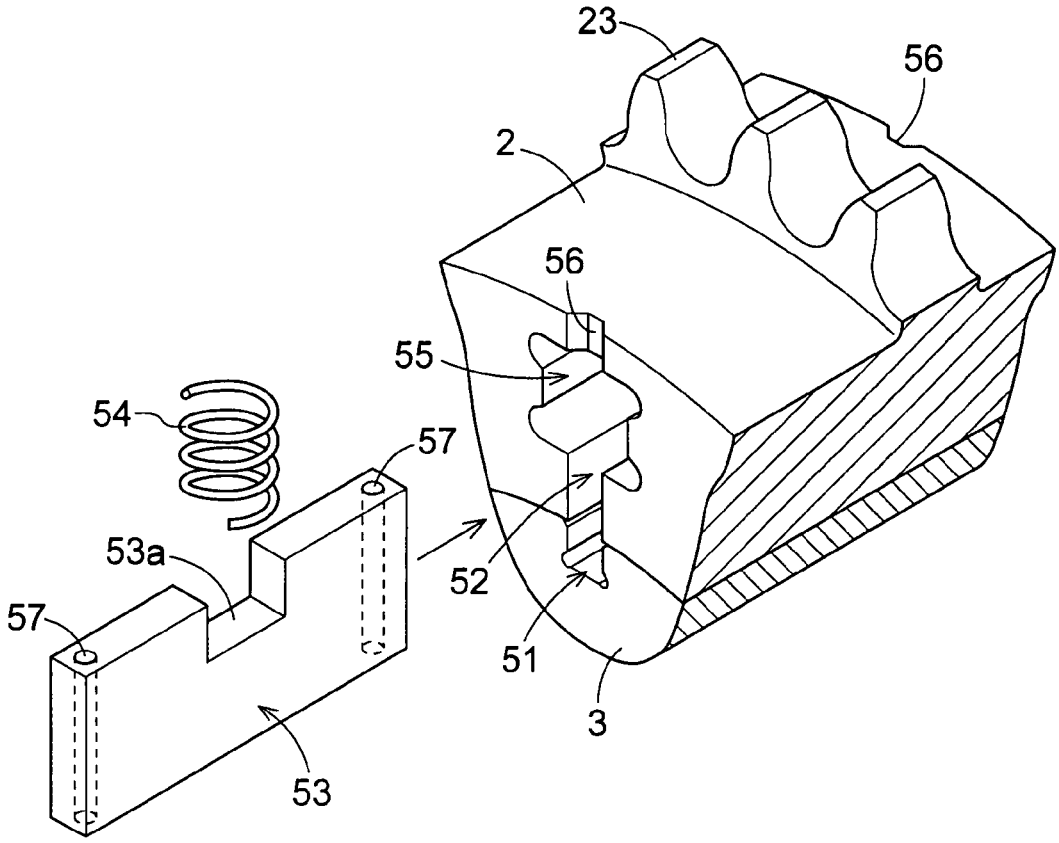
FIG. 13 is an exploded perspective view of the locking mechanism according to the third embodiment of the present invention.
Figure 14:
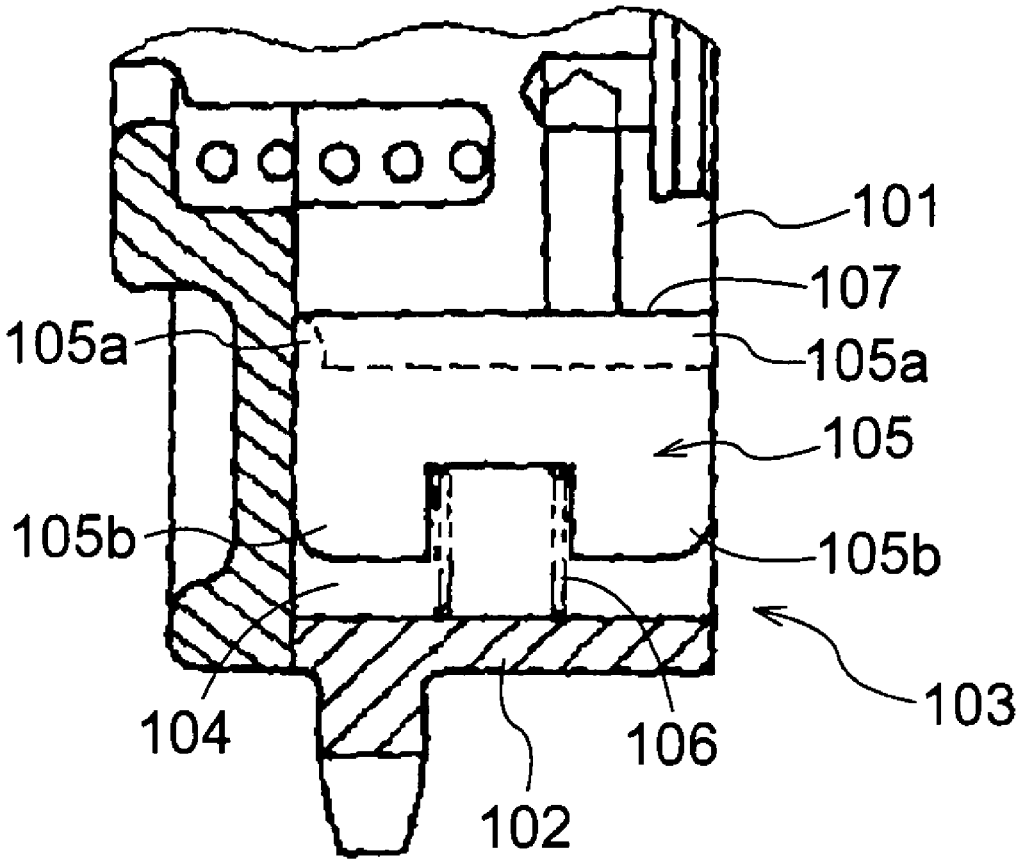
FIG. 14 is a lateral sectional view that shows the configuration of the locking mechanism of a valve timing control apparatus according to the background art.

1 Valve timing control apparatus
2 Outer rotor (drive-side rotating member)
3 Inner rotor (driven-side rotating member)
5 Locking mechanism
6 Phase-controlling mechanism
11 Camshaft
51 Concave engagement part
52 Sliding groove
53 Locking member
56 Discharge channel (discharge port)
57 Hydraulic fluid channel (flow channel for hydraulic fluid)
58 Inlet port

The invention claimed is:

1. A valve timing control apparatus comprising:

a drive-side rotating member that rotates in time with a crankshaft of an internal combustion engine;

a driven-side rotating member that is positioned coaxially with the drive-side rotating member and that rotates in time with a camshaft;

a phase-controlling mechanism for variably controlling a phase of relative rotation between the drive-side rotating member and the driven-side rotating member; and a locking mechanism for restraining displacement of the phase of relative rotation in a prescribed lock phase, wherein the locking mechanism has a sliding groove provided to one of the drive-side rotating member and the driven-side rotating member, a locking member for sliding along the sliding groove, and a concave engagement part that is provided to the other of the drive-side rotating member and the driven-side rotating member, for engaging with the locking member in a state in which the phase of relative rotation is the lock phase, and that has an inlet port from which a hydraulic fluid can be introduced, characterized in that the valve timing control apparatus further comprising:

a flow channel for the hydraulic fluid provided to at least one of the sliding groove and the locking member, formed along a sliding direction of the locking member, and communicatingly connected to the concave engagement parts;

wherein the flow channel for the hydraulic fluid is provided to a sliding surface between the sliding groove and the locking member; and wherein the flow channel for the hydraulic fluid is formed by chamfering a corner part of at least one of the sliding groove and the locking member having a polygonal cross section.

2. The valve timing control apparatus according to claim 1, wherein the flow channel for the hydraulic fluid is communicatingly connected to a discharge port from which the hydraulic fluid is discharged at an end part opposite from a connection to the concave engagement part.

3. A valve timing control apparatus comprising:

a drive-side rotating member that rotates in time with a crankshaft of an internal combustion engine;

a driven-side rotating member that is positioned coaxially with the drive-side rotating member and that rotates in time with a camshaft;

a phase-controlling mechanism for variably controlling a phase of relative rotation between the drive-side rotating member and the driven-side rotating member; and a locking mechanism for restraining displacement of the phase of relative rotation in a prescribed lock phase, wherein the locking mechanism has a sliding groove provided to one of the drive-side rotating member and the driven-side rotating member, a locking member for sliding along the sliding groove, and a concave engagement part that is provided to the other of the drive-side rotating member and the driven-side rotating member, for engaging with the locking member in a state in which the phase of relative rotation is the lock phase, and that has an inlet port from which a hydraulic fluid can be introduced, characterized in that the valve timing control apparatus further comprising:

a flow channel for the hydraulic fluid provided to at least one of the sliding groove and the locking member, formed along a sliding direction of the locking member, and communicatingly connected to the concave engagement part;

wherein the flow channel for the hydraulic fluid is formed by a through-hole extending from a radially inward end surface of the locking member to a radially outward end surface.

4. The valve timing control apparatus according to claim 3, wherein the flow channel for the hydraulic fluid is communicatingly connected to a discharge port from which the hydraulic fluid is discharged at an end part opposite from a connection to the concave engagement part.

* * * * *